US012781741B2

(12) United States Patent
Feng et al.

(10) Patent No.: US 12,781,741 B2
(45) Date of Patent: Nov. 3, 2026

(54) SCROLL COMPRESSOR WITH A SEALING RING FOR A FIXED DISK CHECK VALVE

(71) Applicant: Hitachi-Johnson Controls Air Conditioning, Inc., Tokyo (JP)

(72) Inventors: Allen Feng, Tokyo (JP); Jason Peng, Tokyo (JP); Ben Ma, Tokyo (JP)

(73) Assignee: HITACHI-JOHNSON CONTROLS AIR CONDITIONING, INC., Tokyo (JP)

( * ) Notice: Subject to any disclaimer, the term of this patent is extended or adjusted under 35 U.S.C. 154(b) by 0 days.

(21) Appl. No.: 19/252,057

(22) Filed: Jun. 27, 2025

(65) Prior Publication Data

US 2026/0160249 A1 Jun. 11, 2026
US 2026/0309151 A1 Oct. 8, 2026

(30) Foreign Application Priority Data

Dec. 11, 2024 (CN) ..... 202411822603.X

(51) Int. Cl.
*F04C 18/02* (2006.01)
*F04C 27/00* (2006.01)
*F04C 29/12* (2006.01)

(52) U.S. Cl.
CPC ..... *F04C 18/0215* (2013.01); *F04C 27/00* (2013.01); *F04C 27/005* (2013.01); *F04C 29/126* (2013.01); *F04C 2240/30* (2013.01)

(58) Field of Classification Search
CPC .... F04C 18/0215; F04C 27/00; F04C 27/005; F04C 29/126; F04C 2240/30
See application file for complete search history.

(56) References Cited

U.S. PATENT DOCUMENTS

| | | | | |
|---|---|---|---|---|
| RE35,216 | E | 4/1996 | Anderson et al. | |
| 6,132,191 | A * | 10/2000 | Hugenroth | F04C 29/126 137/220 |
| 7,261,527 | B2 * | 8/2007 | Alexander | F04C 29/126 418/270 |
| 7,429,167 | B2 * | 9/2008 | Bonear | F04C 29/126 92/85 B |
| 10,094,380 | B2 * | 10/2018 | Doepker | F04C 29/126 |

* cited by examiner

*Primary Examiner* — Mary A Davis
(74) *Attorney, Agent, or Firm* — MATTINGLY & MALUR, PC

(57) ABSTRACT

A compressor including a casing, a fixed scroll, an orbiting scroll, a fixed disk check valve, and a sealing ring. The casing includes a first cavity and a mounting seat. The first mounting slot has a slot base which has a first opening that communicates with an outlet port and a slot mouth that communicates with the first cavity. The valve body has a first end and a second end that is provided to be inserted into the first mounting slot. The flange plate is opposite to an end face of an end of the mounting seat facing away from the orbiting scroll, and the sealing ring is looped around the valve body and is disposed between and in abutment with the end face of the end of the mounting seat facing away from the orbiting scroll and the flange plate.

10 Claims, 5 Drawing Sheets

SCROLL COMPRESSOR WITH A SEALING RING FOR A FIXED DISK CHECK VALVE

CROSS-REFERENCE TO RELATED APPLICATION

The present application claims priority from Chinese Patent Application CN 202411822603.X, filed on Dec. 11, 2024, the content of which is hereby incorporated by reference into this application.

TECHNICAL FIELD

The present disclosure relates to the field of gas compression devices, in particular to a compressor.

BACKGROUND

In related art, a compressor is a fluid machine that converts low-pressure gas into high-pressure gas, and is an important component of a refrigeration system. The compressor mainly sucks low-pressure gas from a low-pressure chamber into a compression chamber and discharges the compressed high-pressure gas in the compression chamber to a high-pressure chamber, in order to achieve the conversion of the low-pressure gas into the high-pressure gas. However, when the compressor is shut down, since the gas pressure in the high-pressure chamber is higher than that in the compression chamber, the gas in the high-pressure chamber is prone to leak into the compression chamber, and the high-pressure gas leaked into the compression chamber will drive the compressor to rotate in the opposite direction, resulting in decrease in the gas pressure in the high-pressure chamber and the generation of noise and other phenomena. Thus, the existing compressor has the problem that the gas in the high-pressure chamber is prone to flow back to the compression chamber when it is in the shutdown state.

SUMMARY

Embodiments of the present application provide a compressor to solve the problem of the existing compressor that the gas in the high-pressure chamber is prone to flow back to the compression chamber in the shutdown state.

To solve the above technical problem, the present application is implemented as follows.

In a first aspect, an embodiment of the present application provides a compressor, including a casing, a fixed scroll, an orbiting scroll, a fixed disk check valve, and a sealing ring, the fixed and orbiting scrolls each disposed inside the casing, cooperatively connected to each other, and encircling a compression chamber therebetween, the casing including a first cavity which is located on a side of the fixed scroll facing away from the orbiting scroll;

the side of the fixed scroll facing away from the orbiting scroll is provided with a mounting seat in which a first mounting slot is provided, wherein the first mounting slot has a slot base which is provided with a first opening that communicates with an outlet port of the compression chamber, and a slot mouth that communicates with the first cavity; the fixed disk check valve includes a valve assembly that includes a valve body and a flange plate, wherein the valve body has a first end that is fixedly connected with the flange plate, a second end that is provided to be inserted into the first mounting slot, and an outer side wall that is fixedly connected with a slot wall of the first mounting slot, the flange plate is opposite to an end face of an end of the mounting seat facing away from the orbiting scroll, and the sealing ring is looped around the valve body and is disposed between and in abutment with the end face of the end of the mounting seat facing away from the orbiting scroll and the flange plate.

In the embodiment of the present application, the fixed disk check valve is disposed between the first cavity and the compressor chamber to prevent the flow of the gas in the first cavity back to the compression chamber in the shutdown state of the compressor. Meanwhile, the sealing ring is provided at the connection between the fixed disk check valve and the mounting seat, and disposed between and in abutment with the end face of the end of the mounting seat facing away from the orbiting scroll and the flange plate, so that the sealing ring remains unchanged in position during the operation of the compressor. This is conducive to improving the sealing performance at the connection between the fixed disk check valve and the mounting seat, and further reducing the risk of the gas in the first cavity flowing back to the compression chamber.

BRIEF DESCRIPTION OF THE DRAWINGS

In order to more clearly illustrate the technical solutions of the embodiments of the present application, the accompanying drawings required to use in the description of the embodiments of the present application will be briefly introduced below, and it is obvious that the drawings in the following description are merely some of the embodiments of the present application, and for those having ordinary skills in the art, other drawings can be obtained based on the drawings in the following description without requiring any inventive skills.

DETAILED DESCRIPTION

Figure 1:
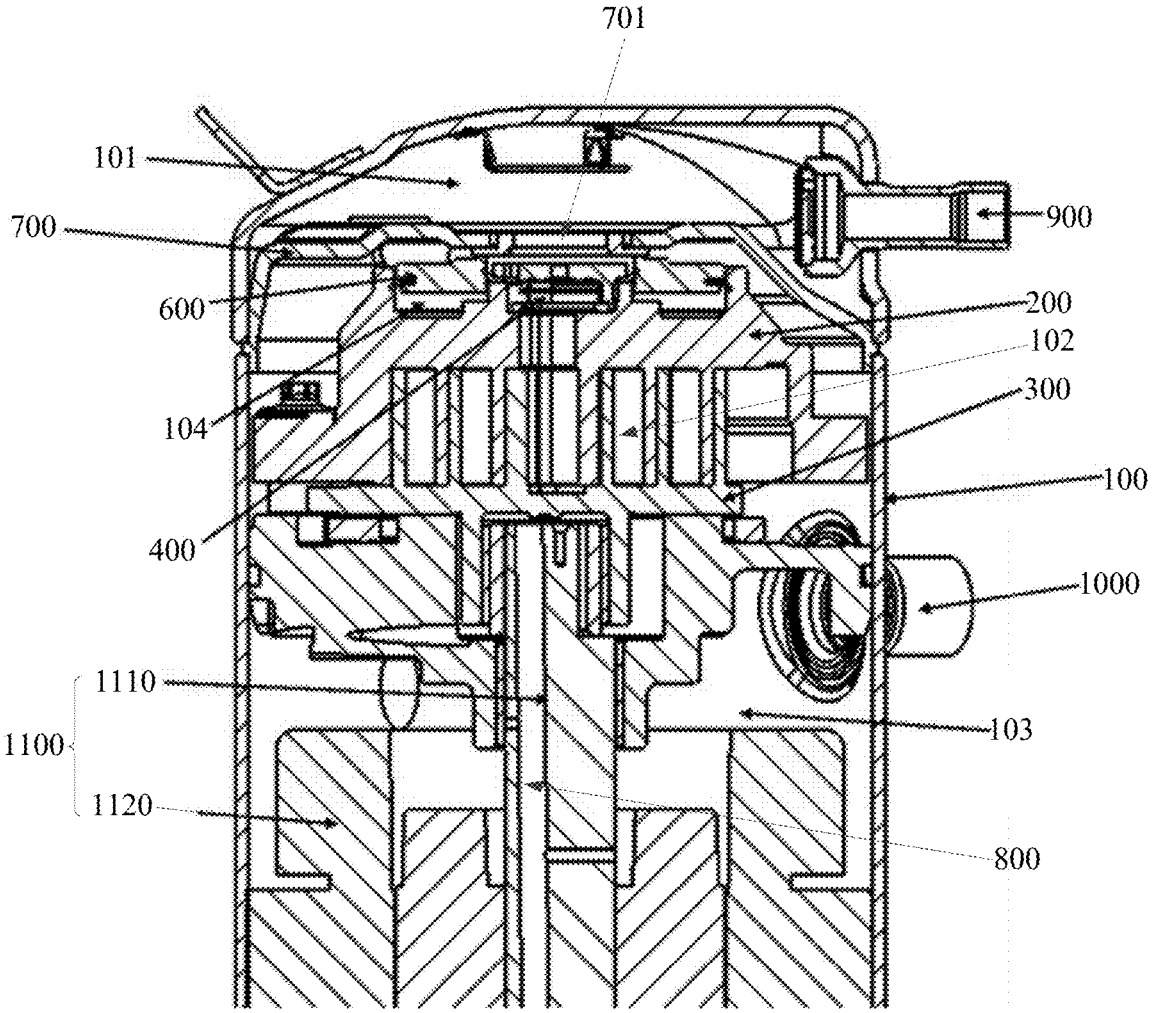
FIG. 1 is a cross sectional view of a compressor in an embodiment of the present application.
Figure 2:
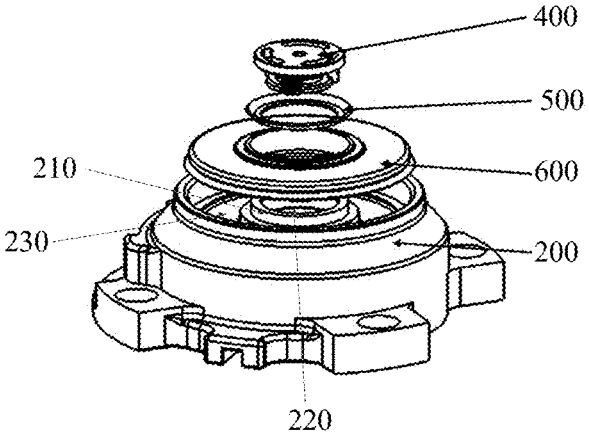
FIG. 2 is a first exploded view of the structure at the connection between a fixed scroll and a fixed disk check valve in the embodiment of the present application.

Hereinafter, technical solutions in the embodiments of the present application will be described clearly and completely in conjunction with the drawings in the embodiments of the present application. Apparently, the described embodiments are a part, but not all, of the embodiments of the present application. All other embodiments, which are obtained by those having ordinary skills in the art based on the embodiments in the present application without exercising inventive skills, fall within the scope of protection of the present application.

Referring to FIGS. 1 to 8, they show a compressor provided in an embodiment of the present application. The compressor includes a casing 100, a fixed scroll 200, an orbiting scroll 300, a fixed disk check valve 400 and a sealing ring 500. The fixed and orbiting scrolls 200, 300 are each disposed inside the casing 100, are cooperatively connected to each other, and encircle a compression chamber 102 therebetween. The casing 100 includes a first cavity 101 which is located on a side of the fixed scroll 200 facing away from the orbiting scroll 300.

The side of the fixed scroll 200 facing away from the orbiting scroll 300 is provided with a mounting seat 210, in which a first mounting slot 220 is provided. The first mounting slot 220 has a slot base, which is provided with a first opening 221 that communicates with an outlet port of the compression chamber 102, and a slot mouth that communicates with the first cavity 101. The fixed disk check valve 400 includes a valve assembly 410 that includes a valve body 411 and a flange plate 412. A first end of the valve body 411 is fixedly connected with the flange plate 412, a second end of the valve body 411 is provided to be inserted into the first mounting slot 220, and an outer side wall of the valve body 411 is fixedly connected with a slot wall of the first mounting slot 220. The flange plate 412 is opposite to an end face of an end of the mounting seat 210 facing away from the orbiting scroll 300, and the sealing ring 500 is looped around the valve body 411 and is disposed between and in abutment with the end face of the end of the mounting seat 210 facing away from the orbiting scroll 300 and the flange plate 412.

The compressor described above may be a scroll compressor, and may be specifically used as a compressor in a heat pump system of an air conditioner. The principle of gas compression by the compressor may be the same as that of various compressors in the heat pump systems of the air conditioners in related art. Accordingly, in the embodiment of the present application, relative structures for gas compression in the compressor may be the same as those inside the various compressors in the heat pump systems of the air conditioners in related art.

Referring to FIG. 1, in some embodiments of the present application, the compressor further includes a second cavity 103, a muffling cover 700, a suction pipe 1000, a discharge pipe 900, and a drive assembly 1100. The muffling cover 700 is disposed inside the casing 100, is hermetically connected to an inner wall of the casing 100, and divides an internal space of the casing 100 into the first cavity 101 and the second cavity 103. Referring to FIG. 1, in some embodiments of the present application, the muffling cover 700 may be located on a side of the fixed disk check valve 400 facing away from the orbiting scroll 300, and is provided with a sixth opening 701 opposite to the fixed disk check valve 400, so that the compressed high-pressure gas flowing out of the fixed disk check valve 400 can enter the first cavity 101 through the sixth opening 701 during the normal operation of the compressor. The first cavity 101 is the high-pressure chamber of the compressor, the second cavity 103 is the low-pressure chamber of the compressor, and the suction pipe 1000 communicates with the second cavity 103 to provide a low-pressure medium to the compression chamber 102, and the discharge pipe 900 communicates with the first cavity 101 to discharge a high-pressure medium.

Specifically, the drive assembly 1100 is connected to the orbiting scroll 300 to drive it to rotate relative to the fixed scroll 200. The drive assembly 1100 may include a crankshaft 800, a first end of which may extend into an oil tank. An end of the orbiting scroll 300 facing away from the fixed scroll 200 may be provided with a bearing seat, inside which a journal bearing may be provided. A second end of the crankshaft 800 may be connected to the journal bearing. A rotary drive module may be installed inside the casing 100, and has a power output end which may be connected to the crankshaft 800 to drive it in rotation. At the same time as the crankshaft 800 rotates, it can drive the orbiting scroll 300 to rotate synchronously to achieve relative rotation between the orbiting and fixed scrolls 300, 200, thereby realizing the gas compression function of the compressor. Various drive assemblies 1100, which are capable of outputting the rotation movement, are possible for the rotary drive module. For example, it may be a conventional motor or an electromagnetic rotary motor, etc. Specifically, referring to FIG. 1, the rotary drive module may include a motor stator 1120 that is connected to an inner wall of the casing 100, and a rotor assembly 1110 corresponding to the motor stator 1120. The motor stator 1120 is cooperatively connected to the rotor assembly 1110 which is connected to the crankshaft 800. In this way, while the motor electronically drives the rotor assembly 1110 to rotate, the crankshaft 800 may synchronously rotate with the rotor assembly 1110.

It will be appreciated that when the compressor is in operation, the fixed disk check valve 400 may be in an open state to communicate the compression chamber 102 with the first cavity 101. At this time, the compressed high-pressure gas discharged from the outlet port 102 of the compression cavity 102 can flow into the first cavity 101 through the fixed disk check valve 400. Correspondingly, when the compressor is not in operation, i.e., when the compressor is in a shutdown state, the fixed disk check valve 400 may be in a closed state. At this time, the compressor chamber 102 does not communicate with the first cavity 101.

In the embodiment of the present application, the flange plate 412 can press the sealing ring 500 against the end face of the end of the mounting seat 210 facing away from the orbiting scroll 300, that is, the sealing ring 500 will not move with other components in the compressor, which is conducive to improving the sealing between the mounting seat 210 and the flange plate 412.

In this embodiment, the fixed disk check valve 400 is provided between the first cavity 101 and the compression cavity 102, to prevent the gas in the first cavity 101 from flowing back to the compression chamber 102 in the shutdown state of the compressor. Meanwhile, the sealing ring 500 is provided at the connection between the fixed disk check valve 400 and the mounting seat 210 and is disposed between and in abutment with the end face of the end of the mounting seat 210 facing away from the orbiting scroll 300 and the flange plate 412, so that the sealing ring 500 remains unchanged in position during the operation of the compressor. This is conducive to improving the sealing between the fixed disk check valve 400 and the mounting seat 210. Moreover, this can further reduce the risk of the gas leaking from the first cavity 101 into an intermediate pressure chamber 104 since the sealing ring 500 functions to isolate the first cavity 101 from the intermediate pressure chamber 104.

Optionally, the sealing ring 500 is an elastic sealing ring, and is in an elastic compression state.

The sealing ring 500 can be made of wear-resistant and high-temperature resistant elastic material to ensure good sealing performance and long service life in high pressure ratio environments. The shape of the sealing ring 500 can be set as needed, and it may have a round, elliptical or another shape, for example.

Figure 6:
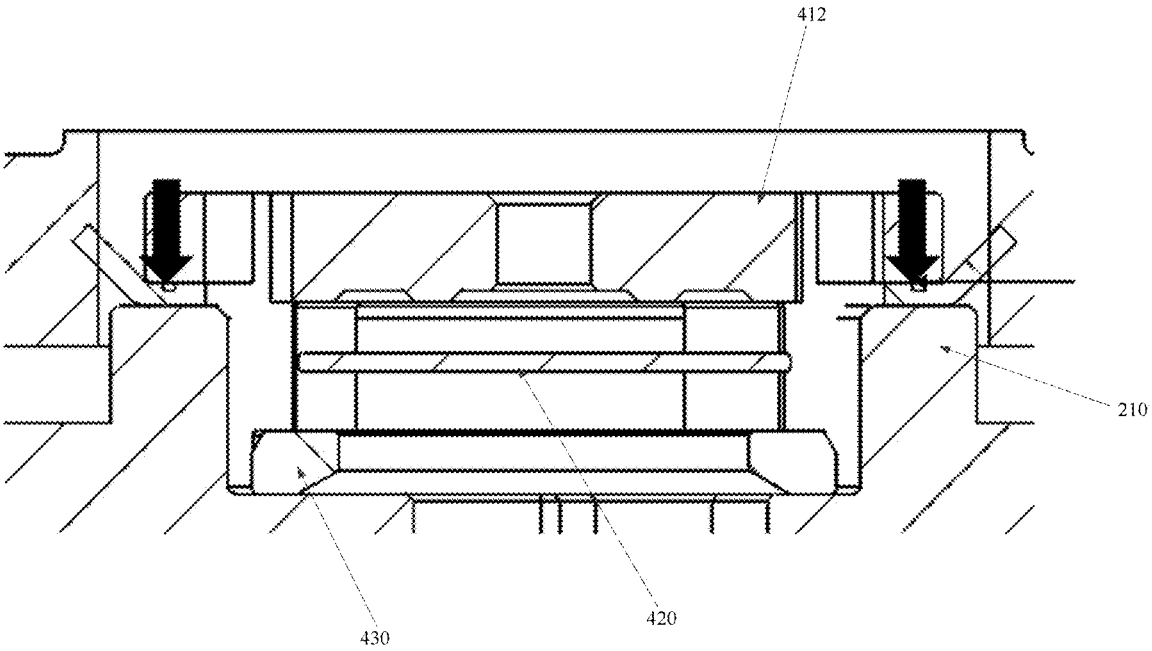
FIG. 6 is a first cross sectional view at the connection between the fixed scroll and the fixed disk check valve in the embodiment of the present application.
Figure 7:
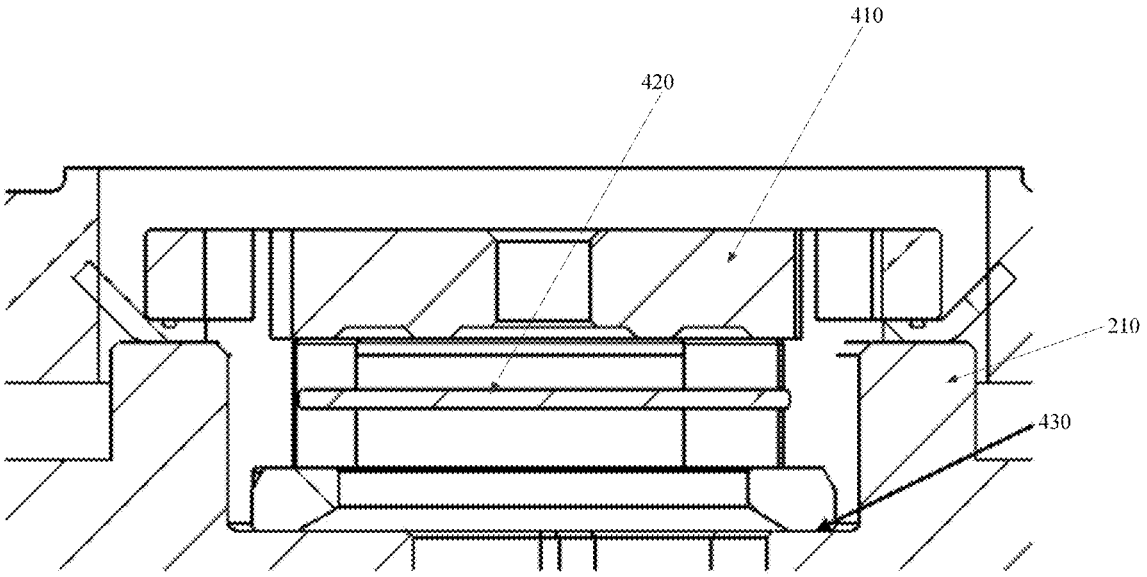
FIG. 7 is a second cross sectional view at the connection between the fixed scroll and the fixed disk check valve in the embodiment of the present application.
Figure 8:
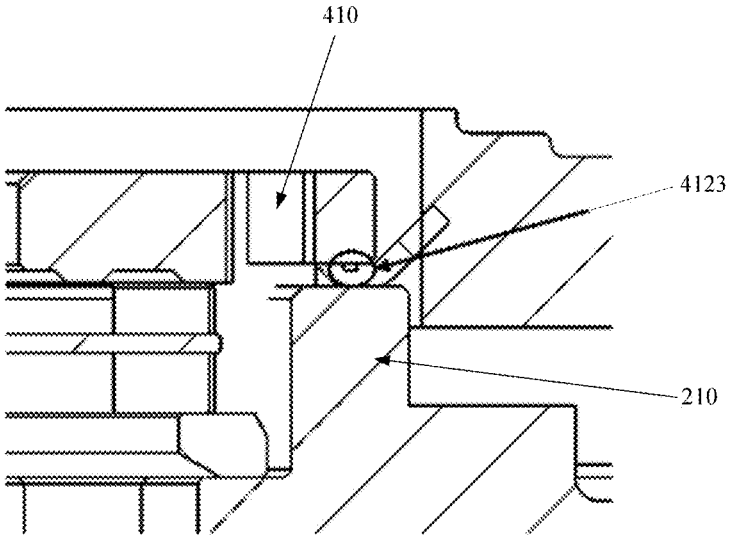
FIG. 8 is a third cross sectional view at the connection between the fixed scroll and the fixed disk check valve in the embodiment of the present application.

Referring to FIG. 6, in some embodiments of the present application, the sealing ring 500 may be axially compressed in directions as shown by solid arrows in FIG. 6, so that both ends of the sealing ring 500 abut against the flange plate 412 and the mounting seat 210, respectively.

In this embodiment, making the sealing ring 500 an elastic sealing ring and in an elastic compression state is conducive to further improving the sealing performance between the mounting seat 210 and the flange plate 412.

Optionally, an end face of an end of the flange plate 412 facing the mounting seat 210 is provided with a limit protrusion 4123, which fits against an outer side wall of the sealing ring 500.

Figure 3:
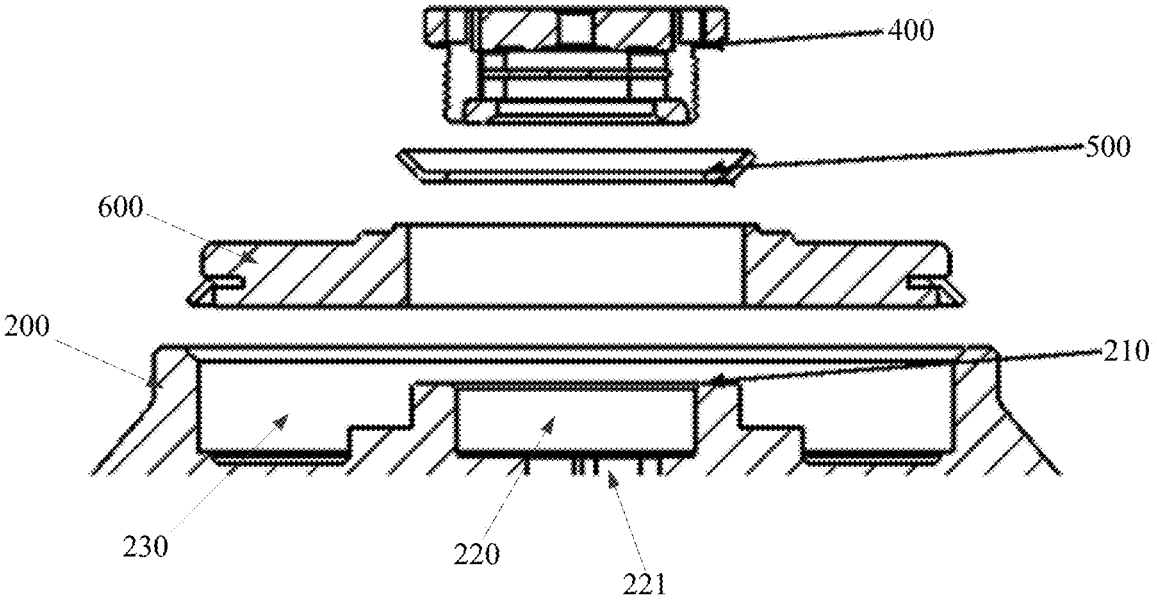
FIG. 3 is a second exploded view of the structure at the connection between the fixed scroll and the fixed disk check valve in the embodiment of the present application.
Figure 5:
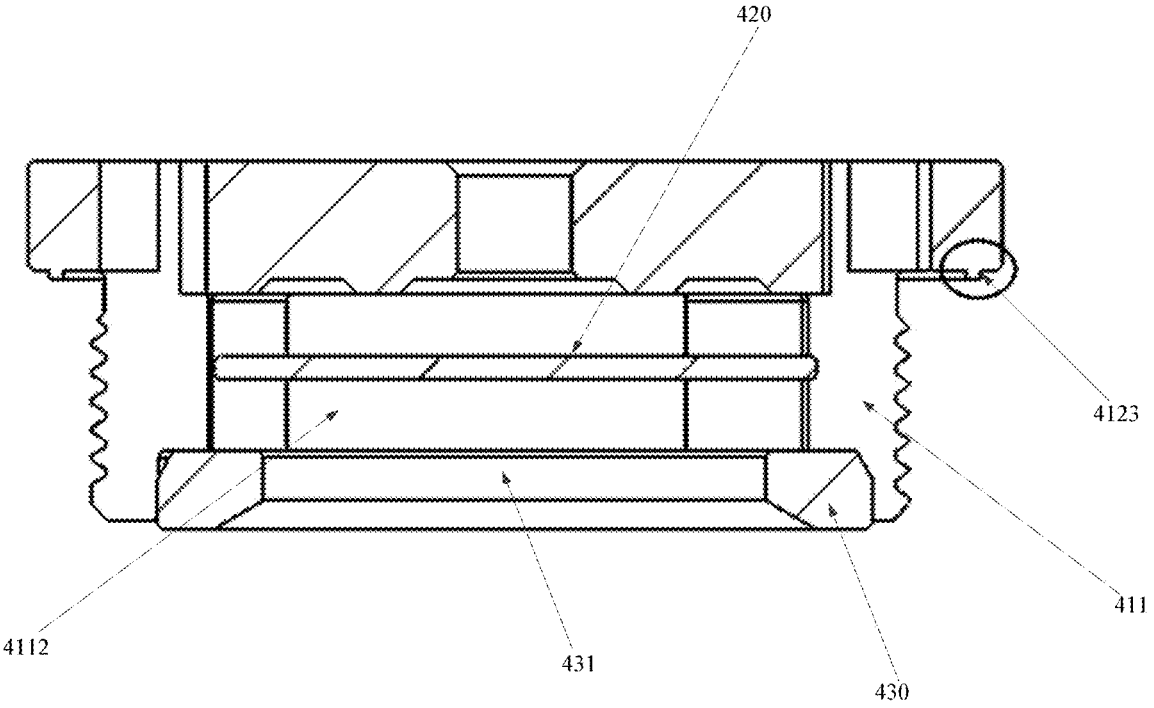
FIG. 5 is a cross sectional view of the fixed disk check valve in the embodiment of the present application.

Referring to FIGS. 3 and 5, the sealing ring 500 may be limited between the limit protrusion 4123 and the outer side wall of the valve body 411.

Referring to FIG. 5, in some embodiments of the present application, the limit protrusion 4123 is an annular protrusion, and is provided therein with a limit hole that matches the sealing ring 500. The sealing ring 500 is located in the limit hole, and its outer side wall fits against a hole wall of the limit hole.

In some other embodiments of the present application, the limit protrusion 4123 may be formed by a plurality of bumps, which can be disposed around the sealing ring 500 to achieve the limiting of the sealing ring 500 in different directions.

In this embodiment, the limit protrusion 4123 is provided on the end face of the end of the flange plate 412 facing the mounting seat 210, and fits against the outer side wall of the sealing ring 500. In this way, it is possible to prevent a radial displacement of the sealing ring 500, so as to fix the position of the sealing ring 500.

Optionally, the end face of the end of the flange plate 412 facing the mounting seat 210 is provided with a limit slot, in which the sealing ring 500 is accommodated, with the outer side wall of the sealing ring 500 fitting against a slot wall of the limit slot.

In this embodiment, the limit slot is provided on the end face of the end of the flange plate 412 facing the mounting seat 210, and the sealing ring 500 is accommodated in the limit slot, with the outer side wall of the sealing ring 500 fitting against the slot wall of the limit slot. In this way, it is possible to prevent the radial displacement of the sealing ring 500, so as to fix the position of the sealing ring 500.

Optionally, the slot wall of the first mounting slot 220 is provided with internal threads, the outer side wall of the valve body 411 is provided with external threads that match the internal threads, and the valve body 411 is connected to the first mounting slot through the threads.

Or alternatively, the valve body 411 is connected to the first mounting slot 220 through interference fit.

Referring to FIG. 3, the internal threads may be provided on the slot wall of the first mounting slot 220, and the external threads, which match the internal threads, may be provided on the outer side wall of the valve body 411. In this way, during the assembly of the fixed disk check valve 400, the external threads of the valve body 411 can be screwed into the internal threads of the first mounting slot 220, so as to achieve the threaded connection between the valve body 411 and the first mounting slot 220, and thus the fixation of the positions of the valve body 411 and the first mounting slot 220.

Alternatively, in some other embodiments of the present application, the valve body 411 can be connected to the first mounting slot 220 through interference fit. In addition, the valve body 411 may be fixedly connected to the first mounting slot 220 using other mechanical fastening means.

In this embodiment, the valve body 411 is connected to the first mounting slot 220 through the threads or interference fit, so as to achieve the fixed connection between the outer side wall of the valve body 411 and the slot wall of the first mounting slot 220.

Optionally, the fixed disk check valve 400 further includes a valve plate 420 and a valve seat 430. The valve body 411 is provided therein with a sliding track 4112 extending from the first end to the second end. The second end of the valve body 411 is provided with a second mounting slot, which has an axis that coincides with the axis of the sliding track 4112, and which has a larger diameter than that of the sliding track 4112. The valve seat 430 is embedded in the second mounting slot, and is fixedly connected to a slot wall of the second mounting slot. The valve seat 430 includes a second opening 431 disposed coaxially with the sliding track 4112 and having a smaller diameter than the sliding track 4112. The side wall of the valve body 411 is provided with a third opening 4111, and the flange plate 412 is provided with a fourth opening 4121 and a fifth opening 4122. The fourth opening 4121 is opposite to the third opening 4111, which communicates with the first cavity 101 through the fourth opening 4121, and the fifth opening 4122 is opposite to the valve plate 420.

The valve plate 420 has a diameter that matches the diameter of the sliding track 4112, and is slidably connected to the sliding track 4112. When the valve plate 420 slides to fit against the valve seat 430, the valve plate 420 closes the second opening 431, and the compression chamber 102 does not communicate with the first cavity 101.

When the valve plate 420 slides to fit against the flange plate 412, the second opening 431 is opened, and the compression chamber 102 communicates with the first cavity 101.

Specifically, during the operation of the compressor, the compressed gas discharged from the outlet port of the compression chamber 102 can enter the sliding track 4112 through the first opening 221 located in the slot base of the first mounting slot 220. In this process, the compressed gas entering from the first opening 221 pushes the valve plate 420 to move towards the flange plate 412 until it fits against the flange plate 412. At the same time, the compressed gas entering the sliding track 4112 can enter the first cavity 101 through the third opening 4111, the fourth opening 4121 and the sixth opening 701 located in the muffling cover 700 in sequence, and can be discharged by the discharge pipe 900. Accordingly, in the shutdown state of the compressor, since the gas pressure in the first cavity 101 is higher than that in the compression chamber 102, the high-pressure gas in the first cavity 101 will move towards the compression chamber 102 and can pass through the flange plate 412 from the fifth opening 4122. The high-pressure gas passing through the flange plate 412 from the fifth opening 4122 can push the valve plate 420 to slide towards the valve seat 430 until it fits against the valve seat 430. At this time, the valve plate 420 closes the second opening 431, so that the high-pressure gas in the first cavity 101 cannot enter the compression chamber 102 through the second opening 431, so as to prevent the gas in the first cavity 101 from flowing back.

In this embodiment of the present application, the number of the third openings 4111 and that of the fourth openings 4121 can each be at least one, and the third openings 4111 are in one-to-one correspondence with the fourth openings 4121, and the third opening 4111 is opposite to and communicates with the corresponding fourth opening 4121.

Figure 4:
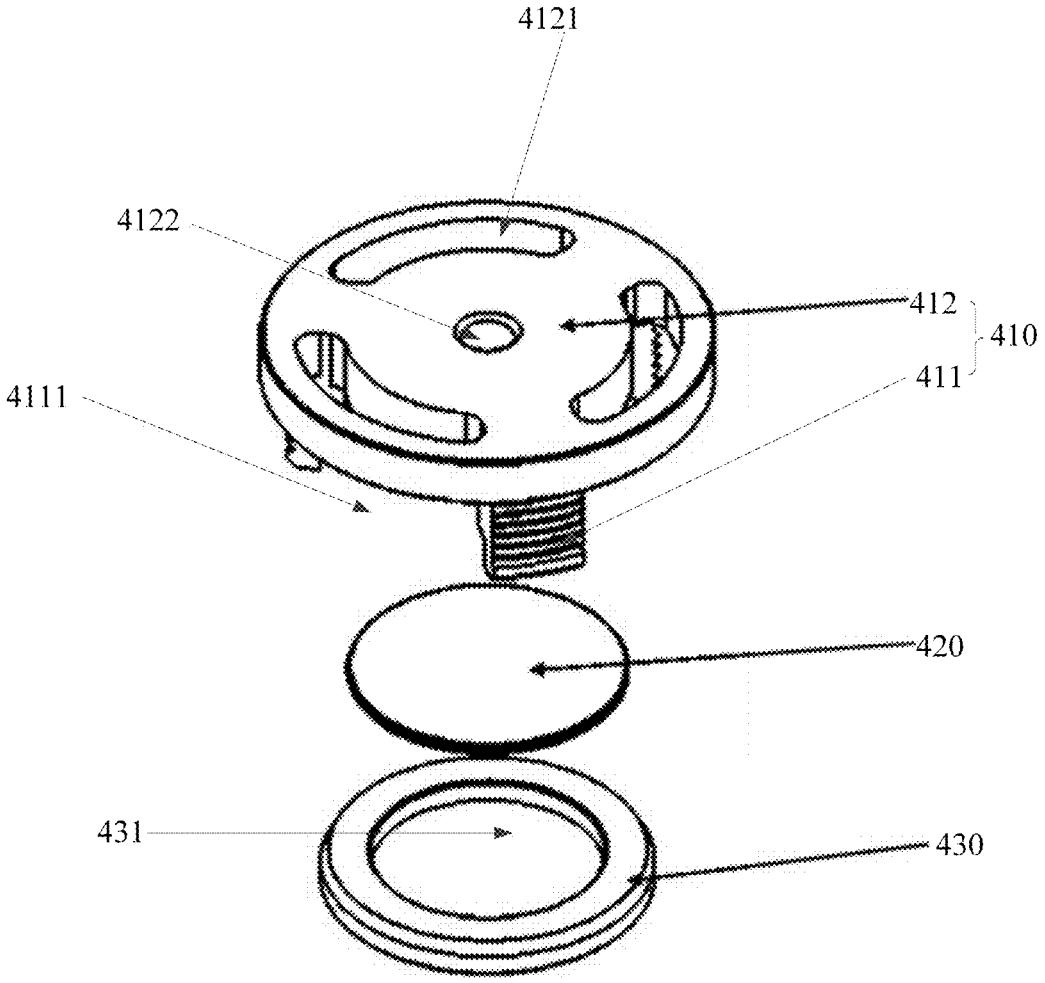
FIG. 4 is a structural exploded view of the fixed disk check valve in the embodiment of the present application.

Referring to FIG. 4, for example, in some embodiments of the present application, the flange plate 412 can be provided with three arc-shaped fourth openings 4121. Accordingly, three corresponding third openings 4111 can be provided in the side wall of the valve body 411. Referring to FIG. 4, the third opening 4111 can extend from the first end to the second end of the valve body 411. In this way, the flow area of the gas flow passage between the first cavity 101 and the compression chamber 102 can be increased during the normal operation of the compressor.

Referring to FIG. 4, the fifth opening 4122 may be a central hole provided at the axis of the flange plate 412. In this way, it may be convenient for the high-pressure gas entering the valve body 411 from the fifth opening 4122 to smoothly push the valve plate 420 to slide towards the valve seat 430 in the shutdown state of the compressor.

Optionally, an end face of an end of the valve seat 430 facing away from a slot base of the second mounting slot extends beyond the second mounting slot, and fits against the slot base of the first mounting slot 220.

In this embodiment, after the fixed disk check valve 400 is installed in the first mounting slot 220, the end face of the end of the valve seat 430 facing away from the slot base of the second mounting slot fits against the slot base of the first mounting slot 220. At this time, the slot base of the first mounting slot 220 serves as a thrust face, preventing the fixed disk check valve 400 from further moving towards the slot base of the first mounting slot 220, and thus ensuring the reliability of the connection between the fixed disk check valve 400 and the first mounting slot 220. Moreover, the thrust face may further provide a support for the fixed disk check valve 400, to ensure the proper mounting position of the sealing ring 500.

Optionally, the compressor further includes a floating seal plate 600, and the side of the fixed scroll 200 facing away from the orbiting scroll 300 is provided with a third mounting slot 230, and the mounting seat 210 is a mounting seat 210 protruding from a slot base of the third mounting slot 230 towards the side facing away from the orbiting scroll 300.

The floating seal plate 600 is annular, and is slidably looped around an outer side of the mounting seat 210, and is hermetically connected to an outer side wall of the mounting seat 210. An outer side wall of the floating seal plate 600 fits against an inner side wall of the third mounting slot 230, and the floating seal plate 600 is hermetically connected to the inner side wall of the third mounting slot 230.

Referring to FIG. 1, in this embodiment of the present application, the floating seal plate 600 can encircle the intermediate pressure chamber 104 with the fixed scroll 200, and the floating seal plate 600 can achieve the isolation of the intermediate pressure chamber 104 from the second cavity 103. Moreover, the floating seal plate 600 and the muffling cover 700 together isolate the first cavity 101 from the second cavity 103.

In this embodiment, the floating seal plate 600 is provided, and it can cooperate with the muffling cover 700 to achieve the isolation of the first cavity 101 from the second cavity 103, further improving the isolation effect between the first cavity 101 and the second cavity 103.

The embodiments of the present application have been described above in conjunction with the drawings, but the present application is not limited to the above specific embodiments, and the above specific embodiments are merely illustrative rather than limiting. Under the teaching of the present application, those having ordinary skills in the art can make many forms without departing from the purpose and scope of protection of the present application, all of which fall within the protection of the present application.

What is claimed is:

1. A compressor, characterized by comprising a casing (100), a fixed scroll (200), an orbiting scroll (300), a fixed disk check valve (400), and a sealing ring (500), the fixed and orbiting scrolls (200, 300) each disposed inside the casing (100), cooperatively connected with each other, and encircling a compression chamber (102) therebetween, the casing (100) comprising a first cavity (101) which is located on a side of the fixed scroll (200) facing away from the orbiting scroll (300);

the side of the fixed scroll (200) facing away from the orbiting scroll (300) is provided with a mounting seat (210) in which a first mounting slot (220) is provided, wherein the first mounting slot (220) has a slot base which is provided with a first opening (221) that communicates with an outlet port of the compression chamber (102), and a slot mouth that communicates with the first cavity (101); the fixed disk check valve (400) comprises a valve assembly (410) that comprises a valve body (411) and a flange plate (412), wherein the valve body (411) has a first end that is fixedly connected with the flange plate (412), a second end that is provided to be inserted into the first mounting slot (220), and an outer side wall that is fixedly connected with a slot wall of the first mounting slot (220), the flange plate (412) is opposite to an end face of an end of the mounting seat (210) facing away from the orbiting scroll (300), and the sealing ring (500) is looped around the valve body (411) and is disposed between and in abutment with the end face of the end of the mounting seat (210) facing away from the orbiting scroll (300) and the flange plate (412).

2. The compressor according to claim 1, characterized in that the sealing ring (500) is an elastic sealing ring and is in an elastic compression state.

3. The compressor according to claim 1, characterized in that an end face of an end of the flange plate (412) facing the mounting seat (210) is provided with a limit protrusion (4123), which fits against an outer side wall of the sealing ring (500).

4. The compressor according to claim 3, characterized in that the limit protrusion (4123) is an annular protrusion, and has a limit hole therein to match the sealing ring (500), and the sealing ring (500) is located in the limit hole and its outer side wall fits against a hole wall of the limit hole.

5. The compressor according to claim 1, characterized in that an end face of an end of the flange plate (412) facing the mounting seat (210) is provided with a limit slot, and the sealing ring (500) is accommodated in the limit slot and its outer side wall fits against a slot wall of the limit slot.

6. The compressor according to claim 1, characterized in that the slot wall of the first mounting slot (220) is provided with internal threads, and the outer side wall of the valve body (411) is provided with external threads that match the internal threads, and the valve body (411) is connected to the first mounting slot (220) through the threads.

7. The compressor according to claim 1, characterized in that the valve body (411) is connected to the first mounting slot (220) through interference fit.

8. The compressor according to claim 1, characterized in that the fixed disk check valve (400) further comprises a valve plate (420) and a valve seat (430), the valve body (411) is provided therein with a sliding track (4112) extending from the first end to the second end, and the second end of the valve body (411) is provided with a second mounting slot, which has an axis that coincides with that of the sliding track (4112) and an diameter that is larger than that of the sliding track (4112), and the valve seat (430) is embedded in the second mounting slot, is fixedly connected with a slot wall of the second mounting slot, and comprises a second opening (431) disposed coaxially with the sliding track (4112) and having a smaller diameter than the sliding track (4112), and a side wall of the valve body (411) is provided with a third opening (4111), and the flange plate (412) is provided with a fourth opening (4121) and a fifth opening (4122), wherein the fourth opening (4121) is opposite to the third opening (4111), which communicates with the first cavity (101) through the fourth opening (4121), and the fifth opening (4122) is opposite to the valve plate (420);

the valve plate (420) has a diameter that matches the diameter of the sliding track (4112), and is slidably connected to the sliding track (4112), wherein when the valve plate (420) slides to fit against the valve seat (430), the valve plate (420) closes the second opening (431), and the compression chamber (102) does not communicate with the first cavity (101);

when the valve plate (420) slides to fit against the flange plate (412), the second opening (431) is opened, and the compression chamber (102) communicates with the first cavity (101).

9. The compressor according to claim 8, characterized in that an end face of an end of the valve seat (430) facing away from a slot base of the second mounting slot extends beyond the second mounting slot, and fits against the slot base of the first mounting slot (220).

10. The compressor according to claim 1, characterized in that the compressor further comprises a floating seal plate (600), and the side of the fixed scroll (200) facing away from the orbiting scroll (300) is provided with a third mounting slot (230), and the mounting seat (210) is a mounting seat (210) protruding from a slot base of the third mounting slot (230) towards the side facing away from the orbiting scroll (300);

the floating seal plate (600) is annular, and is slidably looped around an outer side of the mounting seat (210), and is hermetically connected to an outer side wall of the mounting seat (210), an outer side wall of the floating seal plate (600) fits against an inner side wall of the third mounting slot (230), and the floating seal plate (600) is hermetically connected to the inner side wall of the third mounting slot (230).

* * * * *